US012104453B2

(12) United States Patent
Vasques

(10) Patent No.: US 12,104,453 B2
(45) Date of Patent: Oct. 1, 2024

(54) DOWNHOLE ASSEMBLY AND ANNULAR BARRIER WITH DOWNHOLE ASSEMBLY

(71) Applicant: WELLTEC OILFIELD SOLUTIONS AG, Zug (CH)

(72) Inventor: Ricardo Reves Vasques, Zug (CH)

(73) Assignee: WELLTEC OILFIELD SOLUTIONS AG, Zug (CH)

( * ) Notice: Subject to any disclaimer, the term of this patent is extended or adjusted under 35 U.S.C. 154(b) by 45 days.

(21) Appl. No.: 17/983,725

(22) Filed: Nov. 9, 2022

(65) Prior Publication Data

US 2023/0143383 A1 May 11, 2023

(30) Foreign Application Priority Data

Nov. 10, 2021 (EP) ..... 21207648

(51) Int. Cl.
*E21B 33/13* (2006.01)
*E21B 33/12* (2006.01)
*E21B 36/00* (2006.01)

(52) U.S. Cl.
CPC ..... *E21B 33/13* (2013.01); *E21B 33/12* (2013.01); *E21B 36/00* (2013.01)

(58) Field of Classification Search
CPC ..... E21B 33/13; E21B 33/12; E21B 36/00; E21B 33/127
See application file for complete search history.

(56) References Cited

U.S. PATENT DOCUMENTS 11,519,239 B2 * 12/2022 Greci ..... E21B 17/206
2002/0056553 A1 * 5/2002 Duhon ..... E21B 43/103 166/207

(Continued)

FOREIGN PATENT DOCUMENTS

| | | |
|---|---|---|
| EP | 2 599 956 | 6/2013 |
| WO | 02/099247 | 12/2002 |
| WO | 2021/021203 | 2/2021 |

OTHER PUBLICATIONS

Extended Search Report for EP21207648, dated Mar. 18, 2022, 7 pages.

*Primary Examiner* — Steven A MacDonald
(74) *Attorney, Agent, or Firm* — Nixon & Vanderhye P.C.

(57) ABSTRACT

The present invention relates to a downhole assembly for permanently sealing off a control line controlling a well component of a well tubular metal structure prior to plug and abandonment of a well having a top, comprising a first part of a tubular line, a second part of the tubular line, a downhole closure unit arranged between the first part and the second part of the tubular line and comprising a first element comprising a first opening, a second opening and fluid communication channel between the first opening and the second opening, the first opening being arranged closer to the top than the second opening, the first opening having a first connection to the first part of the tubular line, and the second opening having a second connection to the second part of the tubular line, wherein the first element has a first outer shape in a first state in which the fluid communication channel is open and a second outer shape in a second state in which the fluid communication channel is closed, the second shape being at least partly different from the first outer shape. The invention also relates to a downhole system comprising a well tubular metal structure having an outer face, and the downhole assembly being connected to the outer face and/or the downhole annular barrier. Finally, the invention relates to a method of permanently closing fluid communication in the downhole assembly for permanently sealing off a control line prior to plug and abandonment of a well.

20 Claims, 6 Drawing Sheets

(56) References Cited

U.S. PATENT DOCUMENTS

Figure 1:
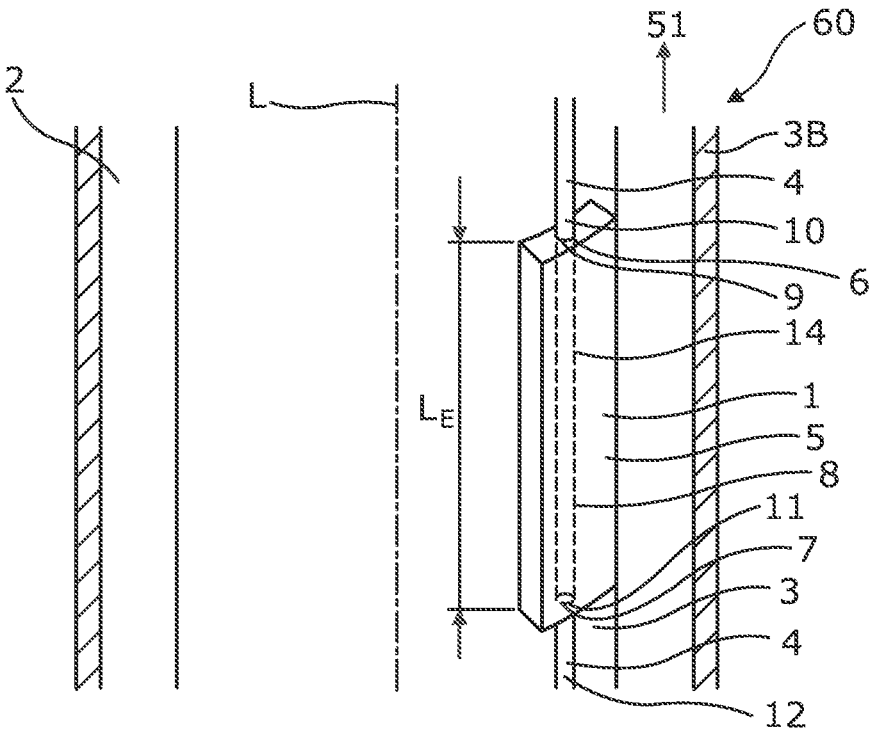

| | | | | |
|---|---|---|---|---|
| 2010/0006289 | A1* | 1/2010 | Spencer | E21B 36/04 166/292 |
| 2013/0087335 | A1* | 4/2013 | Carragher | E21B 36/00 166/57 |
| 2013/0199791 | A1 | 8/2013 | Hill, Jr. et al. | |
| 2017/0342802 | A1* | 11/2017 | Zhao | E21B 34/10 |
| 2020/0040693 | A1* | 2/2020 | Vasques | E21B 33/122 |
| 2022/0025732 | A1* | 1/2022 | Mehta | E21B 33/13 |
| 2023/0147260 | A1* | 5/2023 | Vasques | E21B 43/103 166/387 |
| 2023/0243234 | A1* | 8/2023 | Head | E21B 33/1208 166/302 |

* cited by examiner

DOWNHOLE ASSEMBLY AND ANNULAR BARRIER WITH DOWNHOLE ASSEMBLY

This application claims priority to EP Patent Application No. 21207648.3, filed Nov. 10, 2021, the entire contents of which is/are hereby incorporated by reference.

The present invention relates to a downhole assembly for permanently sealing off a control line controlling a well component of a well tubular metal structure prior to plug and abandonment of a well having a top. The invention also relates to a downhole annular barrier to be expanded in an annulus between a well tubular metal structure and a wall of a borehole or another well tubular metal structure in a well in order to provide zone isolation between a first zone and a second zone of the borehole. Finally, the invention relates to a method of permanently closing fluid communication in the downhole assembly, thus permanently sealing off a control line prior to plug and abandonment of a well.

Many wells are completed with a well tubular metal structure having well components that are controlled from surface by means of control lines. The control line is arranged on the outer face of the well tubular metal structure. During plug and abandonment (P&A), the control line needs to be removed either partly or entirely. If the control line is not removed, the control line breaks at some point along its length during pulling of the well tubular metal structure, preventing control of the location of the control line in the well. When arranging cement down the well to create a cement plug, the control line may extend across the cement plug, creating a potential leak as the fluid may be seeping along the control line. Attempts to develop a tool able to cut an opening in the well tubular metal structure and cut the control line have been many, but none yet successful.

It is an object of the present invention to wholly or partly overcome the above disadvantages and drawbacks of the prior art. More specifically, it is an object to provide an improved well tubular metal structure having a control line in which the well tubular metal structure can easily be plugged and abandoned, thus saving costs compared to existing solutions.

Further, it is an object to provide an improved annular barrier having a control line passing through it which can easily be plugged in a safe manner, e.g. for plug and abandonment, again saving costs compared to existing solutions.

The above objects, together with numerous other objects, advantages and features, which will become evident from the below description, are accomplished by a solution in accordance with the present invention by a downhole assembly for permanently sealing off a control line controlling a well component of a well tubular metal structure prior to plug and abandonment of a well having a top, comprising:

- a first part of a tubular line,
- a second part of the tubular line,
- a downhole closure unit arranged between the first part and the second part of the tubular line and comprising:
  - a first element comprising a first opening, a second opening and fluid communication channel between the first opening and the second opening, the first opening being arranged closer to the top than the second opening, the first opening having a first connection to the first part of the tubular line, and the second opening having a second connection to the second part of the tubular line, wherein the first element has a first outer shape in a first state in which the fluid communication channel is open and a second outer shape in a second state in which the fluid communication channel is closed, the second shape being at least partly different from the first outer shape.

By having a downhole assembly comprising a downhole closure unit fluidly connecting the first part and the second part of the tubular line, a very simple way of fluidly disconnecting the tubular line is provided, and the well completion can therefore easily proceed to the subsequent steps of plug and abandonment of the well as no leaks can occur along the control line when the first element has changed from the first state to the second state. The fluid communication can be closed in a simple manner, and the first part of the tubular line/control line can be pulled out of the well before plugging and abandoning of the well by cement.

Moreover, the first element may change state from the first state to at least partly liquid or mouldable state for closing the fluid communication channel.

By the outer shape of the first element is meant the form of the first element visible from outside the first element and thus the outer surface of the first element.

Also, in the second state a distance between the first part and the second part of the tubular line may be created.

Additionally, the first element may have a through-bore providing the fluid communication channel.

Furthermore, the fluid communication may be provided by a through-bore in the first element from the first opening to the second opening.

Also, the first element may have an inner face contacting an outer face of the well tubular metal structure.

Further, the through-bore may extend within the first element between the first opening and the second opening extending from the first part of the tubular line to the second part of tubular line.

Additionally, the through-bore fluidly may connect the first part of the tubular line with the second part of tubular line.

In addition, the tubular line may not penetrate the first element.

Moreover, the fluid communication may be a fluid channel.

Further, the first element may be tubeless, meaning that the tubular line does not extend through the first element.

Additionally, the through-bore may be tubeless, meaning that tubular line does not extend through the through-bore of the first element.

Also, the well tubular metal structure may have an axial extension, and the first element may have a length along the axial extension being at least 2 cm.

Furthermore, the well tubular metal structure may have an axial extension, and the first element may have a length along the axial extension being at least 2 cm, and preferably at least 5 cm, preferably at least 1 meter, more preferably at least 10 meters.

In addition, the length of the first element may be at least 5 metres, preferably at least 10 metres, and more preferably more than 10 metres.

Moreover, the first element may comprise a post-transition metal material.

A post-transition metal is a metal close to the border between metals and non-metals in the periodic table, i.e. gallium, indium, tin, thallium, lead, and bismuth.

Further, the first element may comprise a material expanding upon solidification.

In addition, the first element may be made of a material having a melting point below 200° C., preferably below 200° C. and above 100° C.

Additionally, the first element may comprise a material liquifying at above 130 degrees centigrade.

Also, the first element may comprise a flange at the second opening.

Furthermore, the first element may comprise a flange at the second opening forming a skirt upon solidification.

In addition, the first element may be made of/comprise a post-transition metal material such as bismuth.

Moreover, the first element may be made of a low-melt-point alloy and/or a eutectic alloy.

Further, the first element may be made of/comprise a low-melt-point alloy such as a bismuth tin (Bi/Sn) alloy and may be a eutectic alloy. The alloy may be a 58/42 bismuth tin (Bi/Sn) alloy, which melts/freezes at 138 degrees centigrade. An alloy will be denser than the fluid filling the well, typically water or brine, and will therefore displace the ambient well fluid in the fluid communication, facilitating the creation of a secure and fluid-tight bond and closure of the fluid communication when activated. The relatively high density of the alloy will also result in a flowable or mouldable alloy behaving in a relatively predictable manner. Alloys may be selected for high mobility such that the mouldable or flowable alloy may flow into and occupy the through-bore. The solidified alloys may thus be effective in sealing the fluid communication and may also securely engage the cement when cement is arranged around the first element to provide the plug for plug and abandonment. Alloys may be selected to be compatible with the other elements of the downhole closure unit of the assembly and the bore wall material, and to be compatible with the conditions in the bore, e.g. relatively high ambient bore temperatures or the presence of corrosive materials, such as hydrogen sulphide and carbon dioxide, which might degrade or otherwise adversely affect other materials. Alternatively, or in addition, the first element may comprise a thermoplastic or some other material or blend of materials. In its hardened state, the material of the first element may comprise an amorphous solid.

Additionally, the first element may comprise at least a first material and a second material, the first material being a post-transition metal material, such as bismuth or a bismuth alloy, and the second material being a non-post-transition metal having a higher melting point than the first material.

Also, the first element may comprise at least a first material and a second material, the first material comprising a eutectic alloy, such as a bismuth alloy, and the second material being a non-post-transition metal having a higher melting point than the first material.

Furthermore, the second material may be formed as a mesh near a second element end comprising the second opening.

In addition, the second material may be formed as a mesh in the lower part to form a skirt around which the bismuth solidifies.

Moreover, the downhole closure unit may further comprise a heating element.

Further, the downhole closure unit may also comprise a power source such as a battery.

Additionally, the invention relates to a downhole annular barrier to be expanded in an annulus between a well tubular metal structure and a wall of a borehole or another well tubular metal structure in a well in order to provide zone isolation between a first zone and a second zone of the borehole, the annular barrier comprising:

a tubular metal part adapted to be mounted as part of the well tubular metal structure, the tubular metal part having an outer face and an inside, an expandable metal sleeve surrounding the tubular metal part and having an inner sleeve face facing the tubular metal part and an outer sleeve face facing the wall of the borehole, each end of the expandable metal sleeve being connected with the tubular metal part, and an annular space between the inner sleeve face of the expandable metal sleeve and the tubular metal part, wherein the annular barrier further comprises the downhole assembly.

By having a downhole assembly comprising a downhole closure unit arranged in the annular space of the annular barrier fluidly connecting the first part and the second part of the tubular line, a very simple way of fluidly disconnecting the tubular line passing therethrough is provided, and the annular barrier can therefore form part of plug and abandonment of the well as no leaks can occur across the annular barrier when the first element has changed from the first state to the second state.

Also, the downhole closure unit may fluidly connect a first part of the tubular line and a second part of the tubular line.

Furthermore, the downhole closure unit may be arranged in the annular space.

In addition, each end of the expandable metal sleeve may be connected to the tubular metal part by means of first and second connection parts.

Moreover, the first part of the tubular line may penetrate a first connection part connecting one end of the expandable metal sleeve and the tubular metal part, and/or the second part of the tubular line may penetrate a second connection part connecting one end of the expandable metal sleeve and the tubular metal part.

Further, the downhole assembly comprising the downhole closure unit, the first part and the second part of the tubular line may fluidly connect the first zone and the second zone.

Additionally, the downhole annular barrier may comprise a valve unit for controlling the flow of fluid from within the tubular metal part into the annular space for expanding the expandable metal sleeve. The valve unit may also comprise a pressure-equalising function in which the annular space is pressure-equalised with the higher of the pressure in the first zone and the second zone, respectively.

Moreover, the fluid communication in the first element may comprise a fuel part of a thermite material.

Further, the wall of the through-bore may be at least partly made of thermite.

Additionally, the battery may power an igniter for making a spark to ignite the thermite material for heating the first element.

Also, the tubular line may comprise a hydraulic fluid or an electric line.

In addition, the invention relates to a downhole system comprising a well tubular metal structure having an outer face, the downhole assembly being connected to the outer face so that an inner face of the downhole closure unit abuts the outer face of the well tubular metal structure.

Furthermore, the invention relates to a downhole system comprising a well tubular metal structure having an outer face, the downhole assembly being connected to the outer face and/or the downhole annular barrier.

In addition, the downhole system may further comprise a wireline tool comprising a heating element for heating the first element.

Moreover, the invention relates to a method of permanently closing fluid communication in the downhole assembly for permanently sealing off a control line prior to plug and abandonment of a well, comprising:

inserting a well tubular metal structure having a completion component and a control line in a tubular line for operating the completion component, the well tubular metal structure comprising the downhole assembly, heating the first element so that the material of the first element at least partly changes state to a more liquified or mouldable state, and expanding the material of the first element during solidification of the material of the first element and thereby closing the fluid communication between the first opening and the second opening.

Furthermore, the invention relates to a method of permanently closing fluid communication in the downhole assembly for permanently sealing off a control line prior to plug and abandonment of a well, comprising:

inserting a well tubular metal structure having a completion component and a control line in a tubular line for operating the completion component, the well tubular metal structure comprising the downhole assembly connecting the first part of the tubular line with the second part of the tubular line, heating the first element so that the material of the first element at least partly changes condition to a more liquified or mouldable condition, and solidification of the at least part of the first element at a distance from the first part of the tubular line forming a gap between the first part of the tubular line and the second part of the tubular line.

In addition, the method may further comprise closing the fluid communication between the first opening and the second opening.

Also, the method may further comprise expanding the material of the first element during solidification of the material of the first element, thereby closing the fluid communication between the first opening and the second opening.

Further, heating may be performed by activating a heating element in the first element or in a wireline tool arranged in abutment to the first element.

Additionally, heating may be performed by pumping an activation fluid down the tubular line.

Also, the activation fluid may be a chemical creating an exothermal process in the first element.

Furthermore, the activation fluid may comprise aluminium metal oxide, e.g. particles of aluminium metal oxide.

In addition, the method may further comprise separating a first part of the well tubular metal structure from a second part of the well tubular metal structure at a position opposite the first element before heating of the first element.

Furthermore, the method may further comprise pulling the first part of the tubular line out of the well.

Moreover, the method may further comprise pulling the first part of the well tubular metal structure out of the well, setting a plug in the second part of the well tubular metal structure and arranging cement on top of the plug and the downhole assembly.

Further, after heating the first element the method may also comprise separating the first part of the tubular line from the second part of the tubular line as the first element changes state.

Additionally, the separation may be performed by means of a wireline tool having a cutting tool and an anchoring section.

Also, the wireline tool may comprise a stroking tool.

Furthermore, the wireline tool may have a driving unit such as a self-propelling unit for propelling the wireline tool forward in the well.

Finally, the method may further comprise pulling the first part of the well tubular metal structure out of the well and inserting a second first part of the well tubular metal structure instead of the pulled first part of the well tubular metal structure.

Figure 6:
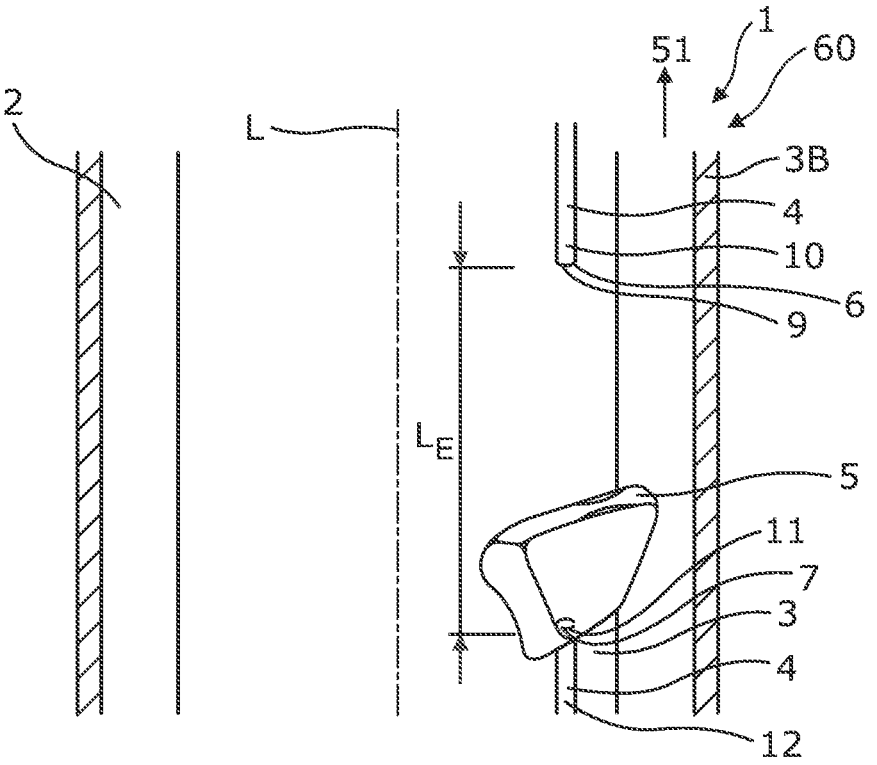
Figure 2:
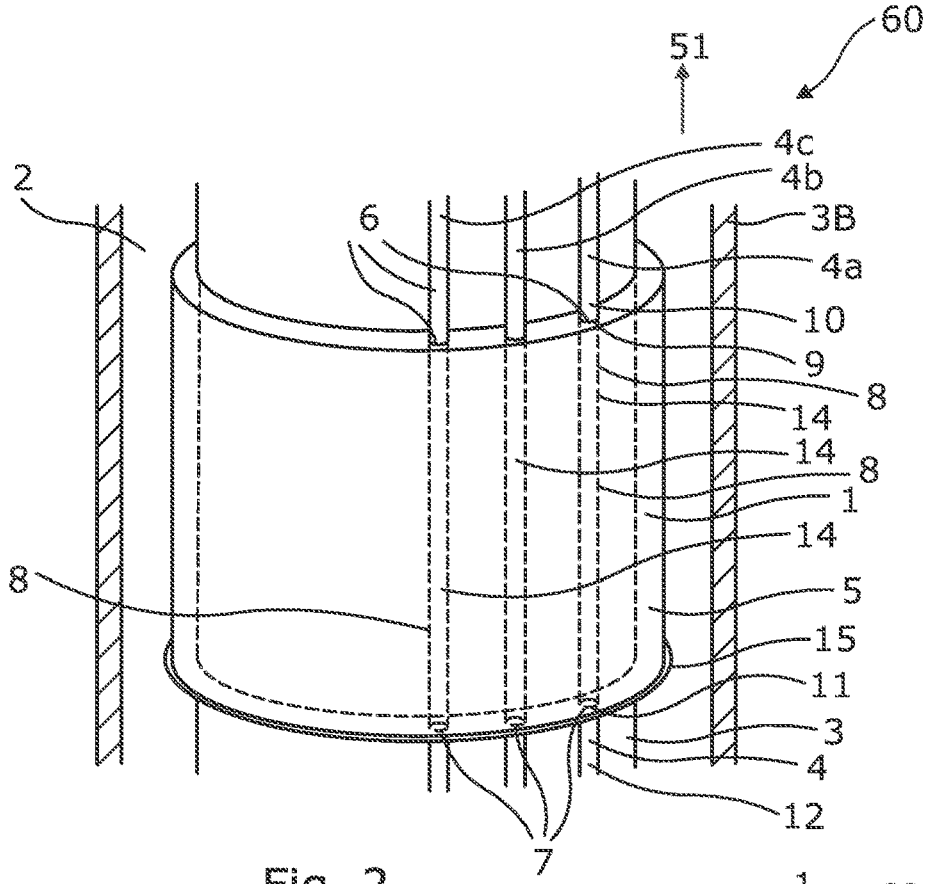
Figure 8:
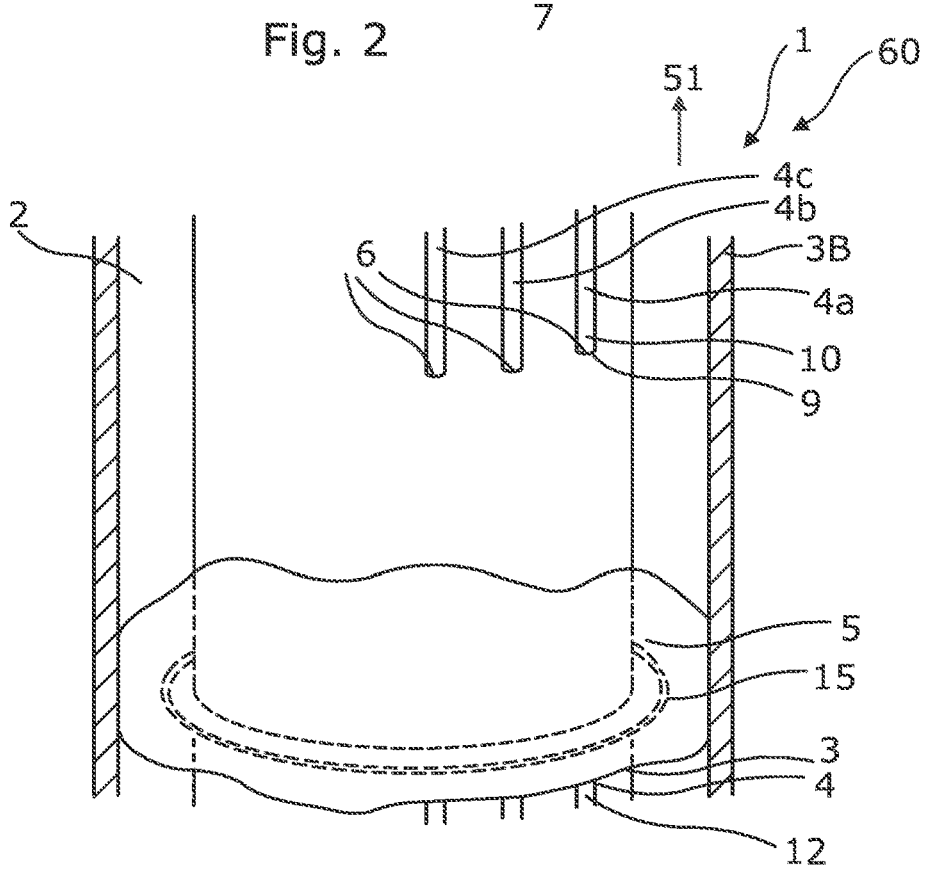
Figure 3:
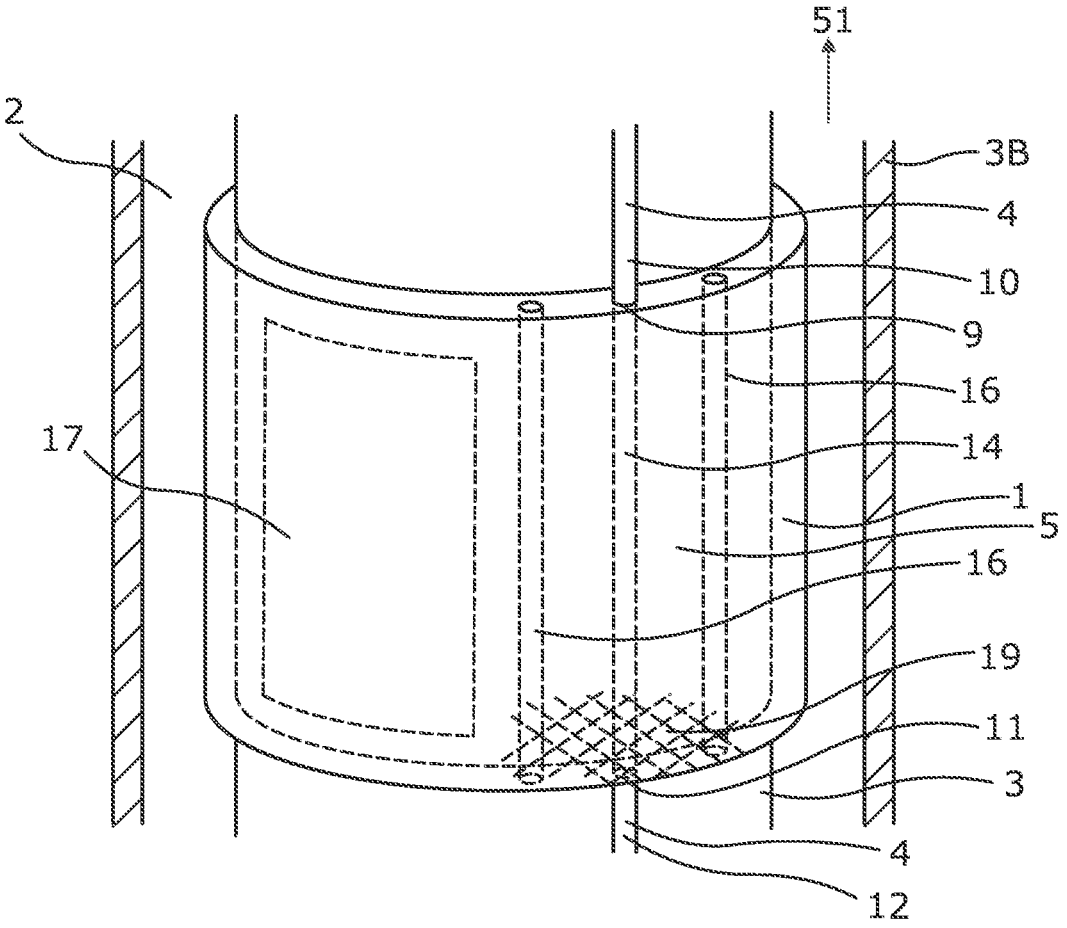
Figures 4A, 4B, 4C, 4D, 4E, 4F:
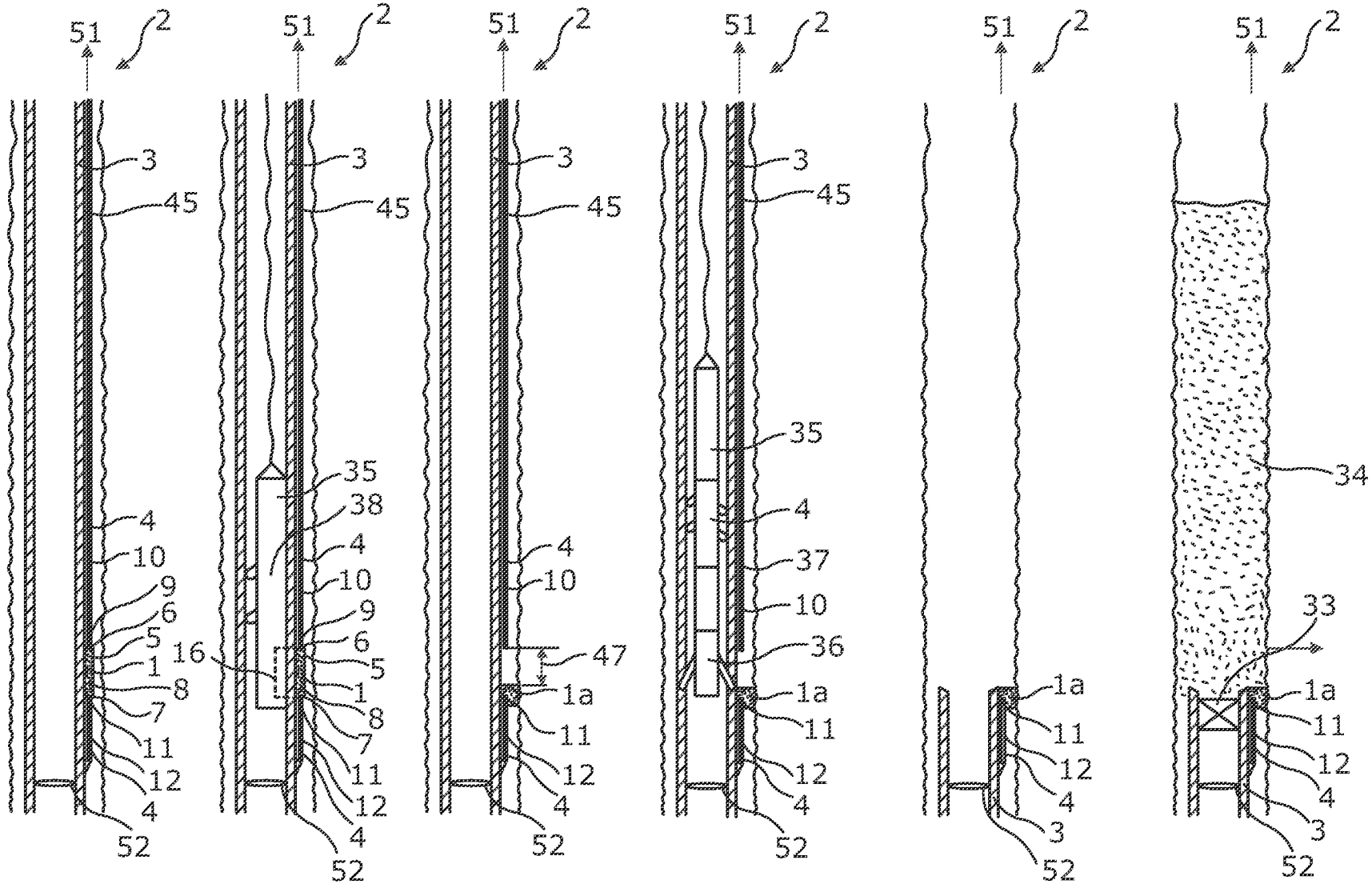
Figure 5A:
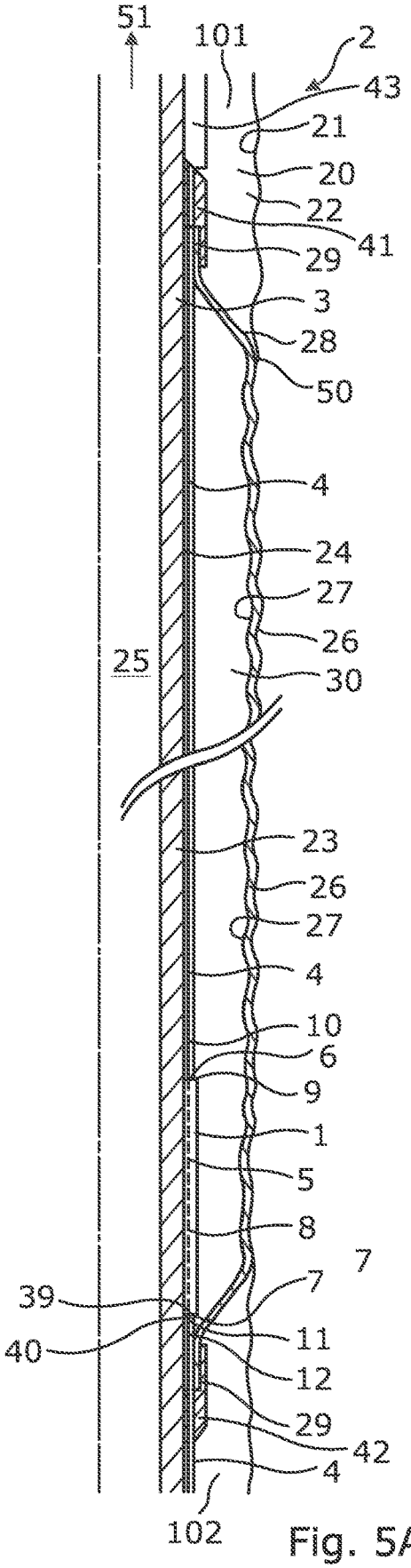
Figure 5B:
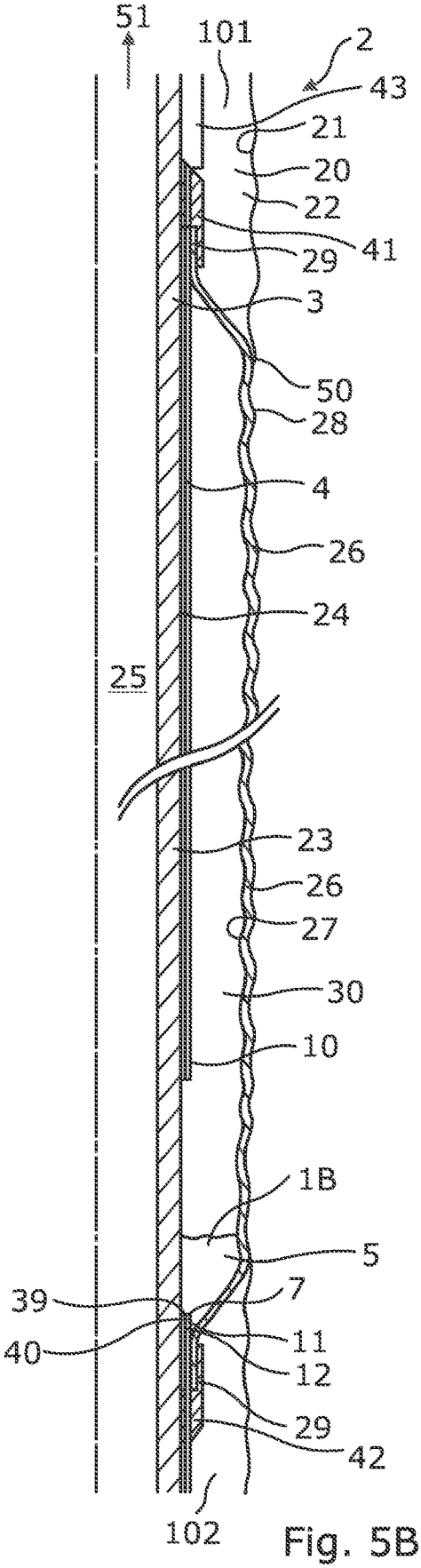
Figure 7:
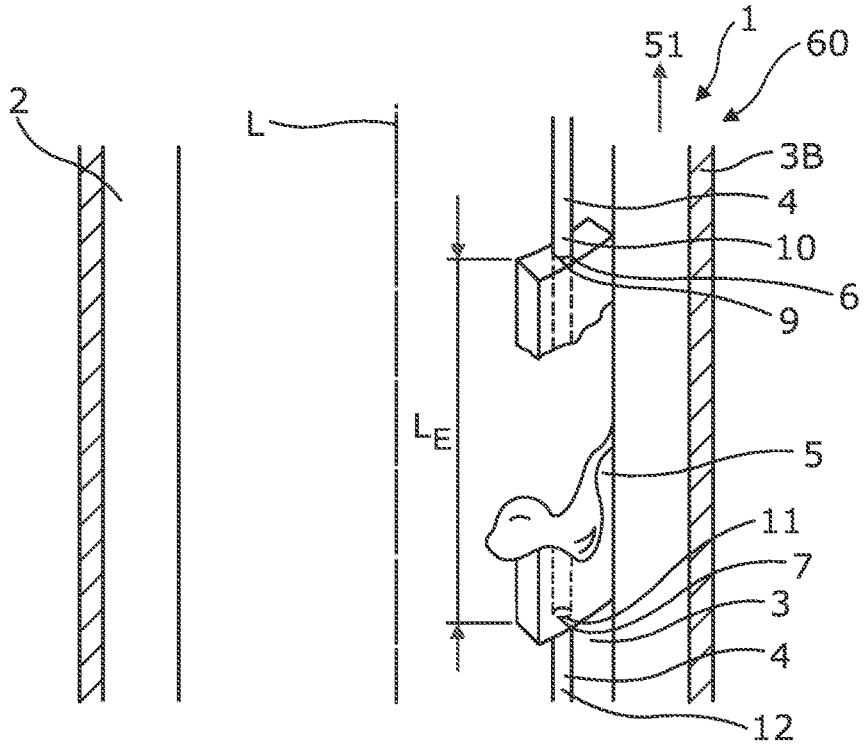
Figure 9:
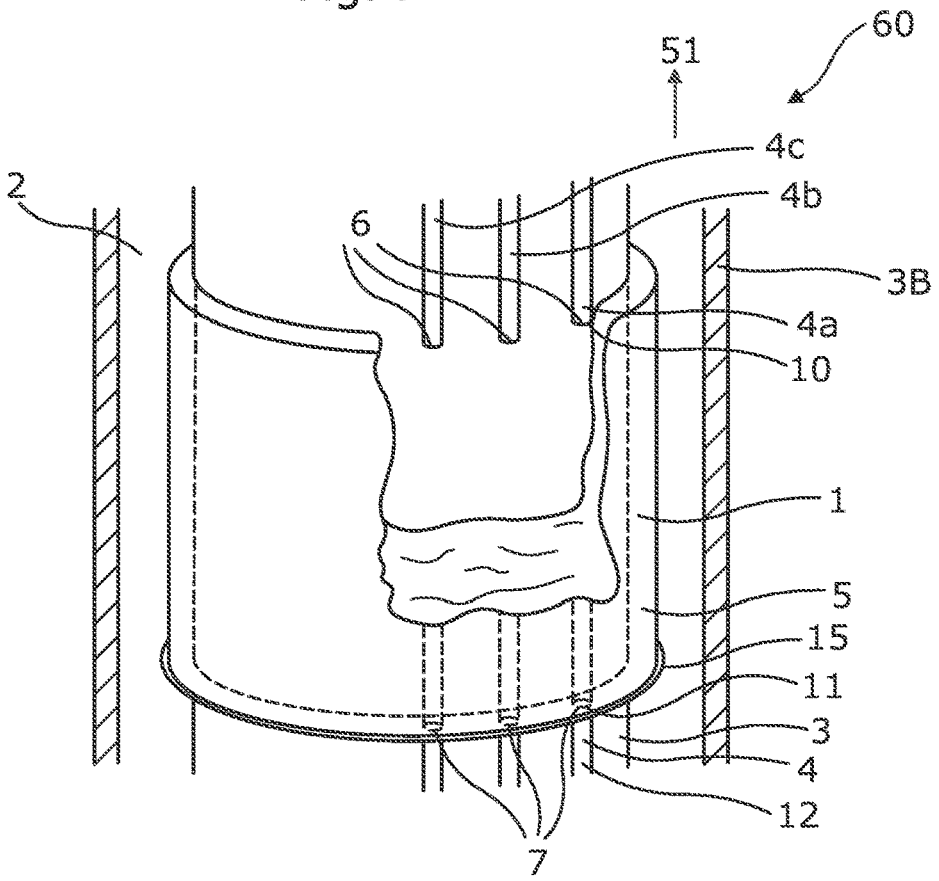

The invention and its many advantages will be described in more detail below with reference to the accompanying schematic drawings, which for the purpose of illustration show some non-limiting embodiments and in which:

FIG. 1 shows a partly cross-sectional view of a well having a well tubular metal structure and a downhole closure unit connecting a first part of a control line and a second part of a control line, FIG. 2 shows a partly cross-sectional view of a well having another downhole closure unit connecting three control lines, FIG. 3 shows a partly cross-sectional view of a well having a well tubular metal structure and another downhole closure unit, FIG. 4A shows a cross-sectional view of a well having a well tubular metal structure and a downhole closure unit, FIG. 4B shows the well of FIG. 4A having a wireline tool with a heating element for heating the first element of the downhole closure unit, FIG. 4C shows the well of FIG. 4B in which the first element has been liquified and solidified at a lower location, creating a closure of the fluid communication between the first part of the tubular line and the second part of the tubular line, FIG. 4D shows the well of FIG. 4C in which a wireline tool is inserted for separating a first part of the well tubular metal structure from a second part, FIG. 4E shows the well of FIG. 4D in which the first part of the well tubular metal structure has been pulled out of the well, FIG. 4F shows the well of FIG. 4E in which cement has been poured down for creating a cement plug for abandoning the well, FIG. 5A shows a cross-sectional view of an annular barrier having a downhole closure unit, FIG. 5B shows a cross-sectional view of the annular barrier of FIG. 5A in which the first element of the downhole closure unit has relocated to close the second part of the tubular line, FIG. 6 shows a partly cross-sectional view of the well having a well tubular metal structure of FIG. 1 and the downhole closure unit in its second state, FIG. 7 shows a partly cross-sectional view of the well having a well tubular metal structure and another downhole closure unit in its second state, FIG. 8 shows a partly cross-sectional view of the well having a well tubular metal structure of FIG. 2 and the downhole closure unit in its second state, and FIG. 9 shows a partly cross-sectional view of the well having a well tubular metal structure and another downhole closure unit in its second state.

All the figures are highly schematic and not necessarily to scale, and they show only those parts which are necessary in order to elucidate the invention, other parts being omitted or merely suggested.

FIG. 1 shows a downhole assembly 60 comprising a downhole closure unit 1 for permanently sealing off a control line 4 controlling a well component 52 (shown in FIGS. 4A-4F) of a well tubular metal structure 3 prior to plug and abandonment of a well 2 having a top 51. The downhole assembly 60 comprises a first part of a tubular line and a second part of a tubular line, where the downhole closure unit 1 is arranged between the first part and the second part. The downhole closure unit 1 comprises a first element 5 comprising a first opening 6, a second opening 7 and a fluid communication 8 between the first opening 6 and the second opening 7. The first opening 6 is arranged closer to the top 51 than the second opening 7 and at a distance from the second opening 7. The first opening 6 has a first connection 9 and is connected to the first part 10 of the tubular line 4, and the second opening 7 has a second connection 11 and is connected to the second part 12 of the tubular line 4. The first element 5 has a first state in which the fluid communication 8 is open, as shown in FIG. 1, and a second state in which the fluid communication 8 is closed, as shown in FIG. 6 or 7. The first element 5 is in FIG. 1 shown in its first state where the first part 10 of the tubular line 4 is fluidly connected with the second part 12 of the tubular line 4 through a fluid communication channel/fluid channel 14 in the first element 5 of the downhole closure unit 1. The first element has a first outer shape in the first state in which the fluid communication channel is open, and a second outer shape in the second state in which the fluid communication channel is closed, and the second outer shape is at least partly different from the first outer shape as shown in FIG. 7 or completely different as shown in FIG. 6. The first element changes state from the first state to the second state via an at least partly liquid state for closing the fluid communication channel, thereby transforming its outer shape from the first outer shape to the second outer shape upon solidification.

The first part of the control line 4 is thus not directly connected to the second part 12 of the tubular line 4 in the first state, but connected via the tubular line 4 so that the tubular line 4 does not penetrate the first element 5. The control line is thus formed by the first part 10 of the tubular line 4, the fluid channel 14 in the first element 5 and the second part 12 of the tubular line 4. The fluid communication 8 is provided by a through-bore 14 forming the fluid channel 14 in the first element 5 from the first opening 6 to the second opening 7. Thus, the first element 5 is tubeless, meaning that the tubular line 4 does not extend through the first element 5, nor through the through-bore 14 of the first element 5.

By having a downhole assembly comprising a downhole closure unit 1 fluidly connecting the first part 10 of the tubular line 4 with the second part 12 of the tubular line 4, the fluid communication channel 8 can be closed in a simple manner, and the first part 10 of the tubular line 4 can be pulled out of the well before plugging and abandoning the well by cement. The downhole closure unit 1 thus provides a very safe way of abandoning a well having a control line for controlling a downhole component. The fluid communication channel 8 can be closed in two ways: either by closing the fluid channel 14 providing the fluid communication 8 in the first element 5 of the downhole closure unit 1 as shown in FIG. 6, or by separating the first part 10 of the tubular line 4 from the second part 12 of the tubular line 4, as shown in FIG. 7, and sealing off the end of the second part 12 of the tubular line 4. When the fluid channel 14 is closed, the cement surrounds, abuts and seals against the first element 5, and when separation is provided cement surrounds, abuts and seals an outer face 45 of the well tubular metal structure 3 directly as the first element 5 has been displaced downwards to its second outer shape, creating access to the outer face 45 of the well tubular metal structure 3 all around the circumference of the well tubular metal structure 3. In either way, the cement does not surround the tubular line/control line 4, and the risk of the well leaking along the tubular line/control line 4 is not present.

The first element 5 changes state and outer shape when the first element 5 is heated above a pre-set temperature at which the first element 5 becomes mouldable or liquified so that the first element 5 disconnects from the first part 10 of the tubular line 4 and accumulates around and above the second part 12 of the tubular line 4 so as to seal off the second part 12 of the tubular line 4 from the first part 10 of the tubular line 4, as shown in FIG. 6, and the first part of the tubular line can be pulled out of the well leaving several meters up to hundreds of meters of well tubular metal structure which is free of a tubular line so that cement can provide a proper seal between the well tubular metal structure and the inner face of the borehole or another well tubular metal structure.

As can be seen in FIG. 1, the well tubular metal structure 3 has an axial extension L, and the first element 5 has a length LE along the axial extension L being at least 2 cm, and preferably at least 5 cm. In another embodiment, the length of the first element 5 may be at least 5 metres, preferably at least 10 metres, and more preferably more than 10 metres. The first element 5 comprises a post-transition metal material, such as bismuth, so that the first element 5 comprises a material expanding upon solidification. The first element 5 may be made of a low-melt-point alloy, such as a material liquifying at above 130 degrees centigrade, and/or a eutectic alloy.

The first element 5 may comprise a low-melt-point alloy such as a bismuth tin (Bi/Sn) alloy and may be a eutectic alloy. The alloy may be a 58/42 bismuth tin (Bi/Sn) alloy, which melts/freezes at 138 degrees centigrade (° C.). An alloy will be denser than the fluid filling the well, typically water or brine, and will therefore displace the ambient well fluid in the fluid communication 8, facilitating the creation of a secure and fluid-tight bond and closure of the fluid communication 8 when activated. The relatively high density of the alloy will also result in a flowable or mouldable alloy behaving in a relatively predictable manner. Alloys may be selected for high mobility such that the mouldable or flowable alloy may flow into and occupy the through-bore. The solidified alloys may thus be effective in sealing the fluid communication 8 and may also securely engage the cement when the cement is arranged around the first element 5 to provide the plug for plug and abandonment. Alloys may be selected to be compatible with the other elements of the downhole closure unit and the bore wall material, and to be compatible with the conditions in the bore, e.g. relatively high ambient bore temperatures or the presence of corrosive materials, such as hydrogen sulphide and carbon dioxide, which might degrade or otherwise adversely affect other materials. Alternatively, or in addition, the first element may comprise a thermoplastic or some other material or blend of materials. In its hardened state, the material of the first element may comprise an amorphous solid.

In FIG. 2, the downhole closure unit 1 comprises a flange 15 at the second opening 7. When the first element 5 is heated and thus enters into a mouldable or liquified condition, the flange 15 forms a skirt upon solidification so that the first element 5 solidifies around the flange 15 and thus above the second part 12 of the tubular line 4, as shown in FIG. 8. By having the flange 15, the solidification is controlled to occur at the position around the flange 15 and the second part 12 of the tubular line 4 to seal off the end of the second part 12 closest to the first part 10. The first part 10 of the tubular line 4 remains open after the first element 5 has changed state to the second state in which the fluid communication 8 is closed. As shown in FIG. 3, the downhole closure unit 1 comprises a mesh 19 in the lower part of the first element 5 to form a skirt around which the material of the first element 5, such as bismuth or a low-melt-point alloy, solidifies. The first element may also solidify before reaching the flange as shown in FIG. 9 only exposing the first part of the tubular lines so that the first parts can be pulled out of the well.

The downhole closure unit 1 may comprise one fluid communication channel 8, 14 as shown in FIG. 1 for providing one fluid communication 8 of the control line 4. In FIG. 2, the downhole closure unit 1 comprises three fluid communications 8 in the form of three fluid channels 14, and thus fluid is connecting a first part 10 and a second part 12 of three tubular lines 4, 4*a*, 4*b*, 4*c*. The tubular lines 4, 4*a*, 4*b*, 4*c* may be used for hydraulic communication or electric communication and thus carry a hydraulic fluid or an electric conductor. Accordingly, the downhole closure unit 1 may comprise a plurality of fluid communications 8 fluidly connecting the first and second parts 10, 12 of a plurality of the tubular lines 4, 4*a*, 4*b*, 4*c*.

In order to heat the first element 5, the downhole closure unit 1 may comprise a heating element 16 and a power source 17, such as a battery, as shown in FIG. 3. The heating element 16 is arranged in two through-bores 14 in the first element 5 on either side of the fluid channel 14 connecting the first part 10 and the second part 12 of the tubular line 4. By heating locally, the material of the first element 5 first becomes mouldable or liquified and then expands during solidification, closing the fluid communication 8 between the first part 10 and the second part 12 of the tubular line 4. Thus, the first element 5 merely changes form locally to fill the fluid channel 14 and thus close the fluid communication 8. The remaining part of the first element 5 remains unchanged even though the first element 5 changes state from the first state to the second state. The mouldable or liquified part of the material of the first element 5 solidifies around the mesh 19 and fills up at least the lower part of the fluid channel 14 nearest the second part 12 of the tubular line 4. The heating element 16 may thus be arranged in the upper part of the downhole closure unit 1 nearest the first part 10 of the tubular line 4, and the mouldable or liquified part of the first element 5 solidifies when flowing down into the lower part of the fluid channel 14.

The downhole closure unit 1 may be heated from within the well tubular metal structure 3 by a wireline tool 35 having the heating element 16, as shown in FIG. 4B. The downhole closure unit 1 completely surrounds the well tubular metal structure 3 in FIG. 2 and only partly surrounds it in FIG. 1. The downhole closure unit 1 may be clamped onto the well tubular metal structure 3 or welded thereto. The downhole closure unit 1 may also only be fastened to the first part 10 and the second part 12 of the tubular line 4, and thus not to the well tubular metal structure 3.

The first element 5 may comprise at least a first material and a second material, the first material being a post-transition metal material, such as bismuth or a bismuth alloy, and the second material being a non-post-transition metal having a higher melting point than the first material. The second material may then form a grid or mesh around which the first material solidifies and may thus control in which position the first material solidifies. The second material may be formed as the mesh 19 near a second element end comprising the second opening 7. The first material may comprise a eutectic alloy, such as a bismuth alloy, the second material being a non-post-transition metal having a higher melting point than the first material.

FIGS. 5A and 5B show a downhole annular barrier 50 to be expanded in an annulus 20 between a well tubular metal structure 3 and a wall 21 of a borehole 22 or another well tubular metal structure (not shown) in a well in order to provide zone isolation between a first zone 101 and a second zone 102 of the borehole 22. The annular barrier 50 comprises a tubular metal part 23 mounted as part of the well tubular metal structure 3, the tubular metal part 23 having an outer face 24 and an inside 25. The downhole annular barrier 50 further comprises an expandable metal sleeve 26 surrounding the tubular metal part 23 and having an inner sleeve face 27 facing the tubular metal part 23 and an outer sleeve face 28 facing the wall 21 of the borehole 22. Each end 29 of the expandable metal sleeve 26 is connected with the tubular metal part 23, defining an annular space 30 between the inner sleeve face 27 of the expandable metal sleeve 26 and the tubular metal part 23. The downhole annular barrier 50 further comprises the downhole closure unit 1 arranged on the outer face 24. The downhole closure unit 1 fluidly connects the first part 10 of the tubular line 4 and the second part 12 of the tubular line 4. The first part 10 of the tubular line 4 penetrates a first connection part 41 connecting one end 29 of the expandable metal sleeve 26 and the tubular metal part 23, and the second part 12 of the tubular line 4 penetrates a second connection part 42 connecting one end 29 of the expandable metal sleeve 26 and the tubular metal part 23. The downhole closure unit 1, the first part 10 and the second part 12 of the tubular line 4 fluidly connect the first zone 101 and the second zone 102.

In FIG. 5A, the material of the first element 5 is in its first state, providing fluid communication 8 between the first part 10 and the second part 12 of the tubular line 4. In FIG. 5B, the first element 5 has liquified and subsequently solidified around the second part 12 of the tubular line 4, thereby sealing off an opening 39 in an upper end 40 of the second part 12 of the tubular line 4. Thus, the first element 5 deforms in the lower part of the annular space 30, sealing off the second part 12 of the tubular line 4 in the annular space 30.

Thus, by having a downhole closure unit 1 arranged in the annular space 30 of the annular barrier 50 a very simple way of fluidly disconnecting the tubular line 4 passing therethrough is provided, and the annular barrier 50 can therefore form part of plug and abandonment of the well as no leaks can occur across the annular barrier 50 when the first element 5 has changed from the first state to the second state.

The downhole annular barrier 50 further comprises a valve unit 43 for controlling the flow of fluid from within the tubular metal part 23 into the annular space 30 for expanding the expandable metal sleeve 26, as shown in FIGS. 5*a* and 5B. The valve unit 43 further comprises a pressure-equalising function in which the annular space 30 is pressure-equalised with the highest of the pressure in the first zone 101 and the second zone 102.

In order to mould or liquify at least part of the first element 5, the fluid communication 8 in the first element 5 may comprise at least a fuel part of a thermite material. The wall 21 of the through-bore 14 creating the fluid communication 8 between the first part 10 and the second part 12 of the tubular line 4 is at least partly made of thermite or covered by thermite, being a pyrotechnic composition of metal powder and metal oxide.

Instead of the heating element 16, the heating may be performed by pumping an activation fluid down the tubular line 4. The activation fluid is a chemical creating an exothermal process in the first element 5, or the activation fluid comprises aluminium metal oxide, e.g. particles of aluminium metal oxide. Oxidizers may include bismuth(III) oxide, boron(III) oxide, silicon(IV) oxide, chromium(III) oxide, manganese(IV) oxide, iron(III) oxide, iron(II,III) oxide, copper(II) oxide or lead(II,IV) oxide. The fuel part in the first element 5 may include aluminium, magnesium, titanium, zinc, silicon or boron. The downhole closure unit 1 may also comprise a battery powering an igniter for making a spark to ignite the thermite material for heating the first element 5.

In FIGS. 4A-4F, a downhole system comprises a well tubular metal structure 3 having the outer face 45, and the downhole closure unit 1 being connected to the outer face 45. As shown in FIG. 4B, the downhole system further comprises the wireline tool 35 comprising the heating element 16 for heating the first element 5.

The fluid communication 8 in the downhole closure unit 1 fluidly connecting the first part 10 of the tubular line 4 with the second part 12 of the tubular line 4 is permanently closed prior to plug and abandonment of a well by first inserting a well tubular metal structure 3 having the completion component 52 and a control line in the tubular line 4 for operating the completion component 52, as shown in FIG. 4A, then heating the first element 5 so that the material of the first element 5 at least partly changes condition to a more liquified or mouldable condition of a downhole closure unit 1*a*, and then expanding the material of the first element 5 during solidification of the material of the first element 5 and thus closing the fluid communication 8 between the first opening 6 and the second opening 7, as shown in FIG. 4C. The heating is performed by activating the heating element 16 in the first element 5 or inserting the wireline tool 35 in abutment to the first element 5, as shown in FIG. 4B. After changing state from the first state to the second state, thus closing the fluid communication 8 and providing a distance 47 between the first part 10 and the second part 12 of the tubular line 4, a first part of the well tubular metal structure 3 is separated from a second part of the well tubular metal structure 3 at a position opposite the first element 5 before heating of the first element 5, e.g. by means of the wireline tool 35 having a cutting tool 36 and an anchoring section 37, as shown in FIG. 4D. Subsequently, the first part of the well tubular metal structure 3 is pulled out of the well, as shown in FIG. 4E, and then a plug 33 is set in the second part of the well tubular metal structure 3, and cement 34 is arranged on top of the plug 33 and the downhole closure unit 1, as shown in FIG. 4F. In order to anchor the wireline tool 35 in the well tubular metal structure 3, the wireline tool 35 may further comprise a stroking tool. The wireline tool 35 may have a driving unit 38, such as a self-propelling unit for propelling the wireline tool 35 forward in the well, as shown in FIG. 4B. Instead of plugging and abandoning the well, a second first part of the well tubular metal structure 3 is inserted instead of the pulled first part of the well tubular metal structure 3.

A stroking tool is a tool providing an axial force. The stroking tool comprises an electric motor for driving a pump. The pump pumps fluid into a piston housing to move a piston acting therein. The piston is arranged on the stroker shaft. The pump may pump fluid out of the piston housing on one side and simultaneously suck fluid in on the other side of the piston.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

In the event that the tool is not submergible all the way into the casing, a self-propelling unit, such as downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. A downhole assembly for permanently sealing off a control line controlling a well component of a well tubular metal structure prior to plug and abandonment of a well having a top, comprising:

a first part of a tubular line, a second part of the tubular line, a downhole closure unit arranged between the first part and the second part of the tubular line and comprising:

a first element comprising a first opening, a second opening and fluid communication channel between the first opening and the second opening, the first opening being arranged closer to the top than the second opening, the first opening having a first connection to the first part of the tubular line, and the second opening having a second connection to the second part of the tubular line, wherein the first element has a first outer shape in a first state in which the fluid communication channel is open and a second outer shape in a second state in which the fluid communication channel is closed, the second shape being at least partly different from the first outer shape, wherein the first element comprises a post-transition metal.

2. A downhole assembly according to claim 1, wherein the first element changes state from the first state to at least partly liquid or mouldable state for closing the fluid communication channel.

3. A downhole assembly according to claim 1, wherein the first element has a through-bore providing the fluid communication channel.

4. A downhole assembly according to claim 3, wherein the through-bore extends within the first element between the first opening and the second opening and extends from the first part of the tubular line to the second part of tubular line.

5. A downhole assembly according to claim 3, wherein the through-bore fluidly connects the first part of the tubular line with the second part of tubular line.

6. A downhole assembly according to claim 1, wherein the tubular line does not penetrate the first element.

7. A downhole assembly according to claim 1, wherein the post-transition metal includes gallium, indium, tin, thallium, lead or bismuth.

8. A downhole assembly according to claim 1, wherein the first element comprises a material expanding upon solidification.

9. A downhole assembly according to claim 1, wherein the first element comprises a flange at the second opening.

10. A downhole assembly according to claim 1, wherein the first element comprises at least a first material and a second material, the first material being the post-transition metal, and the second material being a non-post-transition metal having a higher melting point than the first material.

11. A downhole assembly according to claim 10, wherein the post-transition metal comprises bismuth or a bismuth alloy.

12. A downhole assembly according to claim 1, further comprising a heating element.

13. A downhole annular barrier to be expanded in an annulus between a well tubular metal structure and a wall of a borehole or another well tubular metal structure in a well in order to provide zone isolation between a first zone and a second zone of the borehole, the annular barrier comprising:

a tubular metal part adapted to be mounted as part of the well tubular metal structure, the tubular metal part having an outer face and an inside, an expandable metal sleeve surrounding the tubular metal part and having an inner sleeve face facing the tubular metal part and an outer sleeve face facing the wall of the borehole, each end of the expandable metal sleeve being connected with the tubular metal part, and an annular space between the inner sleeve face of the expandable metal sleeve and the tubular metal part, wherein the annular barrier further comprises the downhole assembly according to claim 1 arranged on the outer face.

14. A downhole system according to claim 13, further comprising a wireline tool comprising the heating element for heating the first element.

15. A downhole system comprising a well tubular metal structure having an outer face, and the downhole assembly according to claim 1 being connected to the outer face.

16. A downhole assembly according to claim 1, wherein the post-transition metal comprises bismuth or a bismuth alloy.

17. A method of permanently closing fluid communication in the downhole assembly according to claim 1 for permanently sealing off a control line prior to plug and abandonment of a well, comprising:

inserting a well tubular metal structure having a completion component and a control line in a tubular line for operating the completion component, the well tubular metal structure comprising the downhole assembly according claim 1 connecting the first part of the tubular line with the second part of the tubular line, heating the first element so that the material of the first element at least partly changes condition to a more liquified or mouldable condition, and solidification of the at least part of the first element at a distance from the first part of the tubular line forming a gap between the first part of the tubular line and the second part of the tubular line.

18. A method according to claim 17, further comprising separating a first part of the well tubular metal structure from a second part of the well tubular metal structure at a position opposite the first element before heating of the first element.

19. A method according to claim 18, further comprising pulling the first part of the well tubular metal structure out of the well, setting a plug in the second part of the well tubular metal structure and arranging cement on top of the plug and the downhole assembly.

20. A downhole assembly for permanently sealing off a control line controlling a well component of a well tubular metal structure prior to plug and abandonment of a well having a top, comprising:

a first part of a tubular line, a second part of the tubular line, downhole closure unit arranged between the first part and the second part of the tubular line and comprising:

a first element comprising a first opening, a second opening and fluid communication channel between the first opening and the second opening, the first opening being arranged closer to the top than the second opening, the first opening having a first connection to the first part of the tubular line, and the second opening having a second connection to the second part of the tubular line, wherein the first element has a first outer shape in a first state in which the fluid communication channel is open and a second outer shape in a second state in which the fluid communication channel is closed, the second shape being at least partly different from the first outer shape, and wherein the downhole assembly further includes a heating element.

* * * * *